United States Patent [19]

Zang et al.

[11] 4,428,331

[45] Jan. 31, 1984

[54] V-TYPE ENGINE INTAKE WITH VIBRATION ISOLATED MANIFOLD

[75] Inventors: Daniel M. Zang, Canton; John W. Huber, Plymouth, both of Mich.

[73] Assignee: General Motors Corporation, Detroit, Mich.

[21] Appl. No.: 299,620

[22] Filed: Sep. 4, 1981

[51] Int. Cl.[3] ..... F02B 75/18

[52] U.S. Cl. ..... 123/52 MV; 123/55 VE

[58] Field of Search ..... 123/52 M, 52 MV, 55 VF, 123/55 VE, 55 VS, 55 V; 60/605; 277/235 B

[56] References Cited

U.S. PATENT DOCUMENTS

| | | | |
|---|---|---|---|
| 2,109,814 | 3/1938 | Balfe | 277/235 B |
| 2,305,295 | 10/1940 | Lang et al. | 60/605 |
| 2,722,203 | 11/1955 | Drinkard et al. | 123/52 MV |
| 3,520,284 | 6/1968 | Rouff et al. | 123/52 MV |
| 3,673,798 | 7/1972 | Kuehl | 60/605 |
| 3,823,702 | 7/1974 | Roberts | 123/188 M |
| 3,942,807 | 3/1976 | Dinger | 277/235 B |
| 4,013,058 | 3/1977 | Hafner et al. | 123/195 R |
| 4,054,108 | 10/1977 | Gill | 123/52 MV |
| 4,118,041 | 10/1978 | Futamura | 277/235 B |
| 4,372,120 | 2/1983 | Ford et al. | 60/605 |

OTHER PUBLICATIONS

Permatex; "This Car Has No Gaskets", Hot Rod, Apr. 1973; p. 35.

Permatex; "The Legend of Old Blue"; Hot Rod, Sep. 1976; p. 108.

*Primary Examiner*—Craig R. Feinberg

*Attorney, Agent, or Firm*—Robert J. Outland

[57] ABSTRACT

The noise level of a V-type diesel engine is reduced by providing an intake manifold assembly including a pair of separate intake manifolds solidly joined by an inlet connector and mounting the complete manifold assembly on the inside valley defining walls of the engine cylinder banks with isolation mounting means that limit the transmission of noise creating vibrations to the manifold assembly and between the cylinder banks through the manifold assembly.

3 Claims, 5 Drawing Figures

V-TYPE ENGINE INTAKE WITH VIBRATION ISOLATED MANIFOLD

TECHNICAL FIELD

This invention relates to internal combustion engines having V-arranged cylinder banks and more particularly to sound reducing isolated manifold means for such engines.

BACKGROUND

U.S. patent application Ser. No. 232,890 filed Feb. 9, 1981 now U.S. Pat. No. 4,372,120, and its abandoned parent application, Ser. No. 88,298 filed Oct. 26, 1979, both entitled V-Type Engine Intake with Vibration Isolated Manifold Connector, illustrate prior manifold arrangements found effective to reduce radiated noise in V-type engines. The disclosures of these applications are hereby incorporated by reference into the present application.

In the embodiments illustrated in the drawings of the referenced applications, isolation means are provided between the cylinder bank mounted manifolds of a V-type engine and the manifold connector which extends between those manifolds. This arrangement was found to reduce noise radiated from the engine, apparently through reducing the transmission of vibrations between the cylinder banks and their connected manifolds and from the cylinder banks and manifolds to the connector.

SUMMARY OF THE INVENTION

The present invention provides an improved vibration isolation arrangement for V-type engine manifolds which is applicable to multi-piece manifold arrangements of the sort described in the previously mentioned patent applications as well as to other manifold arrangements connected between the cylinder banks of a V-type engine.

Arrangements according to the present invention differ from those illustrated in the previously mentioned patent applications in that in the present invention the entire manifold assembly is mounted upon the opposite cylinder banks with vibration isolating gasket and securing means. By this arrangement, transmission of vibrations from the cylinder banks and their associated cylinder head portions is reduced not only to and through the manifold connector but also to the individual manifolds connected to each of the cylinder banks. With this result, it has been found that the overall level of noise reduction is greater than that realized with the prior arrangement wherein only the manifold connector is isolation mounted on the individual manifolds.

In addition to its application to multipiece manifold assemblies as herein described, the present arrangement is further capable of being utilized for the isolation mounting of integrally cast or fabricated manifolds on the opposite cylinder banks of V-type engines.

These and other features and advantages of the invention will be more fully understood from the following description of certain preferred embodiments taken together with the accompanying drawings.

BRIEF DRAWING DESCRIPTION

DETAILED DESCRIPTION

Figure 4:
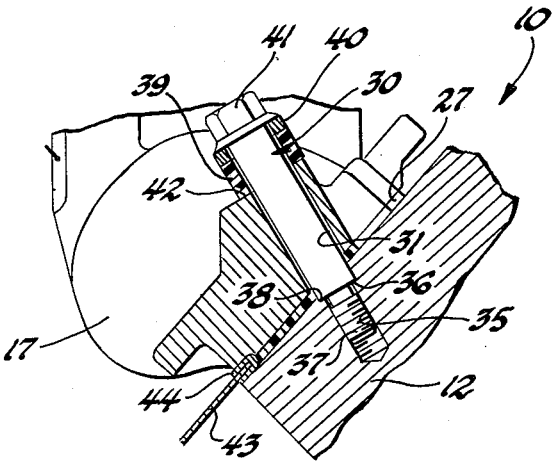
FIG. 4 is a fragmentary cross-sectional view taken in the plane indicated by the line 4—4 of FIG. 2.

Referring now to the drawings in detail, numeral 10 generally indicates a V-type diesel internal combustion engine which, except for the manifold mounting arrangement to be subsequently discussed, is generally of the type shown in FIG. 4 of the above indicated U.S. Pat. No. 4,372,120. The engine is of the turbocharged type but the turbocharger has been deleted from the drawings to allow a better view of the manifold mounting arrangement.

Engine 10 includes a cylinder block 11 with two cylinder banks on each of which there is mounted one of a pair of cylinder heads 12, 14. The cylinder heads conventionally include air intake ports, not shown, which are supplied with intake air by a manifold assembly 15. The manifold assembly includes a pair of intake manifolds 16, 17 and a manifold connector 18. The connector 18 extends between the manifolds and is secured to both by bolts 19, the joints being sealed by relatively firm gaskets 20.

The connector 18 comprises an elongated body to which air is supplied from a tubular inlet portion 22 arranged to receive air from the turbocharger compressor via a flexible hose, not shown. The air received is delivered by the connector to the manifolds 16, 17 and thence to the various cylinders of the engine.

Atop the connector 18, though not internally connected therewith, there is mounted an air inlet fitting 23 which is adapted to receive an air intake filter or other air delivery device, not shown. The inlet fitting has an outlet portion 24 that is connectable via a rubber hose, not shown, or other vibration absorbing conduit means with the inlet of the turbocharger compressor also not shown in the drawing.

In order to provide the desired reduction or control of noise radiation from the engine, the entire manifold assembly and its attached air inlet fitting are resiliently mounted in vibration isolation to the engine cylinder banks. This is accomplished by providing relatively soft, resilient manifold gaskets 26, 27 made of any suitable material, such as for example low durometer silicone. The gaskets are installed between the manifolds 16, 17 of the manifold assembly 18 and the associated cylinder heads 12, 14 which are mounted upon and form a part of the engine cylinder banks.

The individual manifolds, and thereby the manifold assembly, are retained on the cylinder heads by shoulder bolts 30 which extend through bolt openings 31 in the manifolds and are secured in threaded openings 35 of the respective cylinder heads. The bolts 30 include stop shoulders 36 which are of slightly larger diameter than their threaded portions 37 received in the openings 35. The latter are provided with counterbored annular abutments 38 which are engaged by the bolt stop shoulders 36 to limit the travel of the bolts, thus providing controlled limited compression of the sealing gaskets 26, 27 when the bolts are secured. Isolation of the bolts from the respective manifolds of the manifold assembly is provided by elastic sleeves 39 which extend between washers 40 under the bolt heads 41 and the opposing surfaces 42 of the respective manifolds 16, 17 of the manifold assembly.

In an optional feature, a thin metal valley cover 43 extending between the cylinder banks and retained against the cylinder heads under the manifolds 16, 17 is provided with resilient seal strips 44 enclosing its edges and received in grooves defined between the manifolds and the cylinder heads. This construction adequately secures the valley cover in the desired location as well as maintains the desired vibration isolation of the manifolds and manifold assembly from the cylinder banks.

In operation the described embodiment of manifold assembly, formed by individual manifolds firmly secured together by a separate connector and mounting a separate inlet fitting, is effectively isolated against the transmission of noise creating vibrations from the opposite cylinder banks to which it is attached by the isolation mounting means comprising resilient gaskets 26, 27 and elastic sleeves 39 engaging mounting bolts 30. Thus, the transmission of vibrations to the manifold assembly from the cylinder banks and the transmission of vibrations between the cylinder banks through the manifold assembly is effectively limited. This provides a reduced level of noise transmission from the engine as compared with the application of a solidly mounted manifold or manifold assembly. It further provides reduced noise transmission from the previously mentioned arrangement wherein the manifolds are solidly connected with the cylinder banks and the manifold connector is mounted on isolation mounting means between the manifolds.

In addition to the arrangement so far described, it is clearly within the contemplation of the invention to provide an integral one piece manifold in place of the three piece manifold assembly and to mount the integral manifold by isolation mounting means between and connected with the two cylinder banks of an engine. Such an arrangement should also provide the benefits of reduced noise transmission by isolating the manifold from the transmission of noise creating vibrations from the cylinder banks as in the described embodiment.

Figure 5:
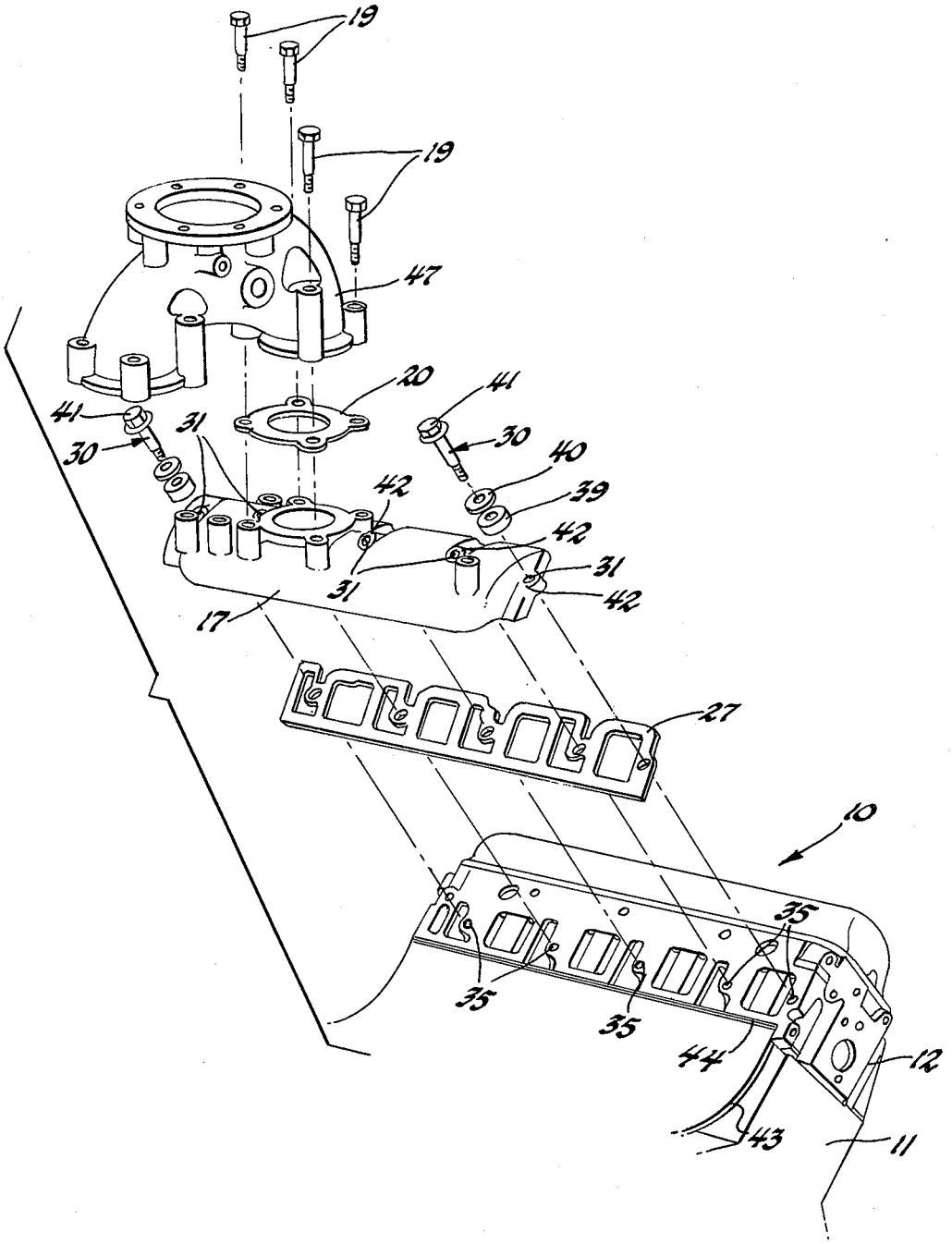
FIG. 5 is an exploded pictorial view illustrating the relationship of some of the components of a slightly modified form of isolated manifold arrangement in accordance with the invention.

Referring now to FIG. 5 of the drawings, there is disclosed in pictorial exploded fashion a portion of an engine manifold arrangement similar to that previously described and differing only in the form of the inlet connector. In the FIG. 5 embodiment, like reference numerals are used to identify those elements which are identical with those of the previously described embodiment. The only element which differs is the inlet connector 47 which is solidly secured in assembly with the inlet manifolds, only one of which 17 is shown. Bolts 19, gaskets 20 and elastic sleeves are provided to make the connection as in the previous embodiment.

Figure 1:
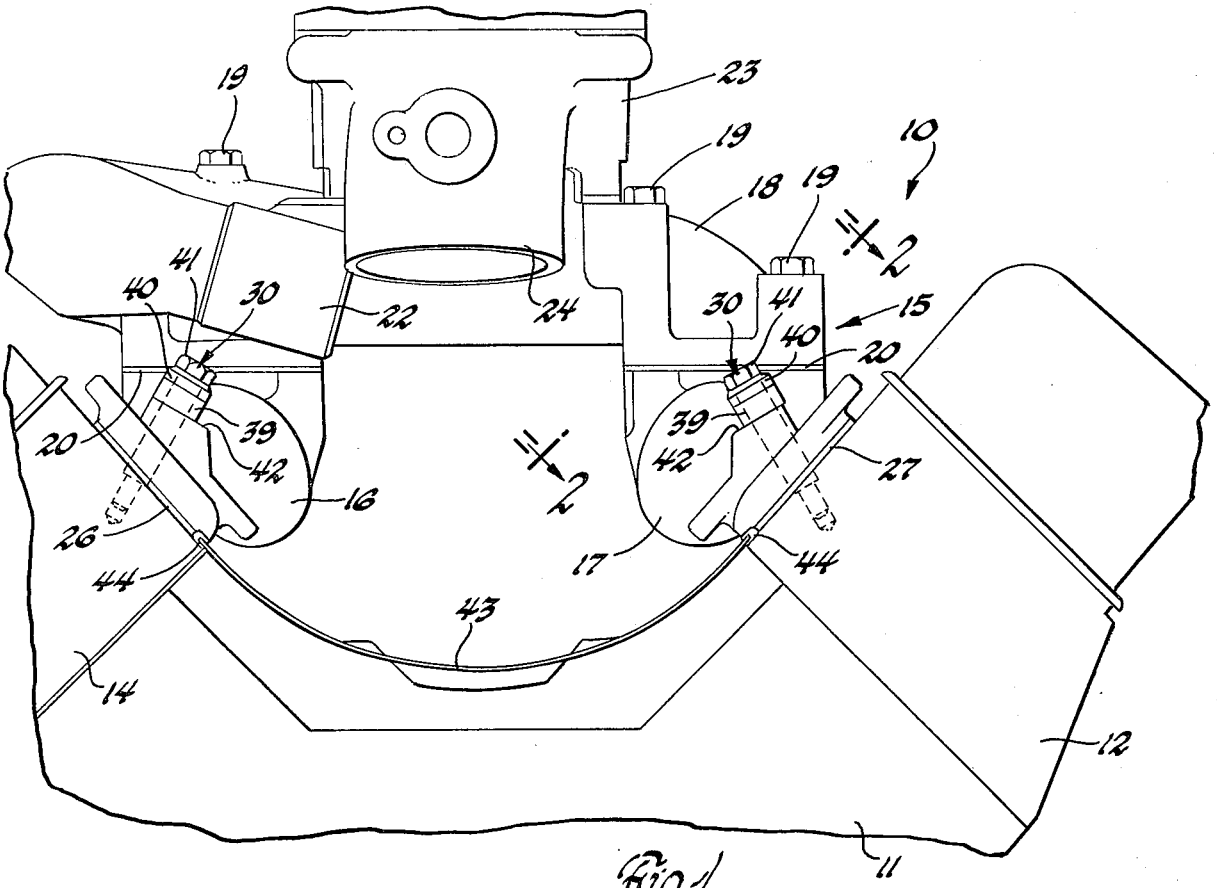
FIG. 1 is a fragmentary end view showing the upper portions of a V-type diesel internal combustion engine having an intake system with isolated manifold means in accordance with the invention.
Figure 2:
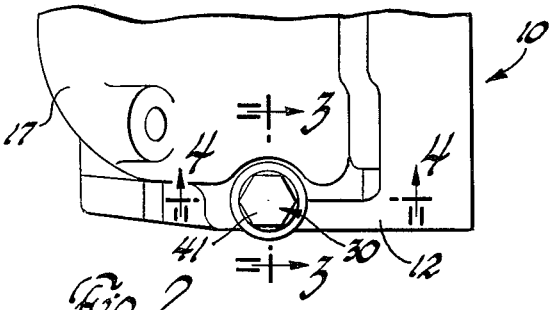
FIG. 2 is a fragmentary plan view of a portion of the manifold means as viewed from the plane generally indicated by the line 2—2 of FIG. 1.
Figure 3:
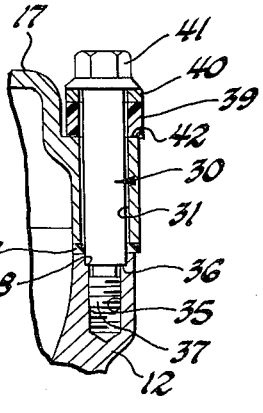
FIG. 3 is a fragmentary cross-sectional view taken in the plane indicated by the line 3—3 of FIG. 2.

The general arrangement of the embodiment of FIG. 5 is much like that of FIG. 1 of the previously mentioned application Ser. No. 232,890. It differs, however, in that the connector 47 is solidly connected in assembly with the manifolds 16, 17. Also, the complete manifold assembly is isolation mounted on the cylinder heads, only one of which 12 is shown, by means of the resilient gaskets 26, 27 and elastic sleeves 39 retained by shoulder bolts 30 in the manner indicated with respect to the first described embodiment with similar noise isolating results.

While the invention has been described by reference to certain preferred embodiments, it should be understood that numerous additional changes could be made within the spirit and scope of the inventive concepts described. Accordingly, it is intended that the invention not be limited except in accordance with the language of the following claims.

The embodiments of the invention in which an exclusive property or privilege is claimed are defined as follows:

1. In combination in a V-type engine having a pair of angularly disposed cylinder banks extending from a common crankcase and defining an intermediate valley, intake manifold means secured to and connecting with both said cylinder banks to carry charging air from a common supply and diverging outward to cylinders in said cylinder banks, and isolation mounting means between and solely connecting said manifold means and said cylinder banks to limit the transmission of noise creating vibrations between the cylinder banks and to the manifold means, said isolation mounting means including resilient vibration isolating gaskets between and engaging each of said cylinder banks and said manifold means to seal joints and prevent direct contact therebetween, and isolated controlled compression securing means acting between said manifold means and said cylinder banks for retaining said manifold means on said cylinder banks with predetermined partial compression of said gaskets while preventing non-resilient solid contact between the manifold means and the cylinder banks through said securing means.

2. In combination in a V-type engine having a pair of angularly disposed cylinder banks extending from a common crankcase and defining an intermediate valley, a pair of separate air intake manifolds each having a surface secured to a different one of said cylinder banks and spaced laterally diverging from one another in a direction of and on opposite sides of the valley to deliver air charges to the engine cylinders, a manifold mounted upon and interconnecting both said intake manifolds via an opposite surface of each of said manifolds to carry charging air from a common supply to the manifolds, and isolation mounting means between said manifolds and said cylinder banks to limit the transmission of noise creating vibrations between the cylinder banks and to the manifolds and connector, said isolation mounting means including resilient gaskets between each of said cylinder banks and their respective manifolds to seal joints and prevent direct contact therebetween, and isolated controlled compression securing means acting between said manifolds and said cylinder banks for retaining said manifolds on said cylinder banks with predetermined partial compression of said gaskets while preventing non-resilient solid contact between the manifolds and the cylinder banks through said securing means.

3. In combination in a V-type engine having a pair of angularly disposed cylinder banks extending from a common crankcase and defining an intermediate valley, a manifold assembly comprising a pair of separate air intake manifolds each having a surface secured to a different one of said cylinder banks and spaced laterally diverging from one another in a direction of and on opposite sides of the valley to deliver air charges to the engine cylinders, and a manifold connector mounted solidly without substantial isolation upon and interconnecting both said intake manifolds via an opposite surface of each of said manifolds to carry charging air from a common supply to the manifolds, and isolation mounting means between said manifold assembly and said cylinder banks to limit the transmission of noise creating vibrations between the cylinder banks and to the manifold assembly, said isolation mounting means including resilient gaskets between each of said cylinder banks and the manifold assembly to seal joints therebetween, and isolated controlled compression securing means acting between said manifolds and said cylinder banks for retaining said manifold assembly on said cylinder banks with predetermined partial compression of said gaskets while preventing non-resilient solid contact between the manifold assembly and the cylinder banks through said securing means.

* * * * *